United States Patent [19]

Stevenson et al.

[11] Patent Number: 4,776,355

[45] Date of Patent: Oct. 11, 1988

[54] SMOKING ARTICLES

[75] Inventors: William W. Stevenson, Lake Elmo; Joseph Graham, New Hope, both of Minn.

[73] Assignee: Minnesota Mining and Manufacturing Company, St. Paul, Minn.

[21] Appl. No.: 877,803

[22] Filed: Jun. 24, 1986

[51] Int. Cl.[4] ..... A24D 1/10

[52] U.S. Cl. ..... 131/352; 131/349; 131/365

[58] Field of Search ..... 131/352, 331, 349, 365, 131/309, 310

[56] References Cited

U.S. PATENT DOCUMENTS 3,183,914 5/1965 Cohn ..... 131/352

*Primary Examiner*—V. Millin

*Attorney, Agent, or Firm*—Donald M. Sell; David W. Anderson

[57] ABSTRACT

Smoking articles, such as cigarettes and little cigars, having self-extinguishing properties when laid on a flat surface yet will not extinguish when held in the hand or placed in an ashtray, are disclosed. The tobacco filler composition of the smoking articles is modified by the addition thereto of a moisture stable alkali metal silicate, the preferred moisture stable alkali metal silicate being borate stabilized sodium silicate.

5 Claims, No Drawings

SMOKING ARTICLES

BACKGROUND OF THE INVENTION

This invention relates to smoking articles such as cigarettes and little cigars having self-extinguishing properties when laid on a flat surface yet will not extinguish when held in the hand or placed in an ashtray. For many years, attempts have been made to design a cigarette with such self-extinguishing properties but none has resulted in a cigarette acceptable to the consumer.

Cigarettes have been recognized to be a great safety problem for many years. It has been reported that a patent for a self-extinguishing cigarette was first issued in 1854 and about one hundred other patents have been issued since then. The safety problem continues because the claimed self-extinguishing feature either does not work or the "solution" has been impractical.

Approaches to the control of the fire hazards of burning cigarettes have involved various schemes.

U.S. Pat. No. 3,183,914 discloses the use of an intumescent material as a constituent of the tobacco filler. High water content sodium silicate having a weight ratio of sodium monoxide:silicon dioxide within the range of 2:1 to 1:4, in the form of granules, is mixed with the tobacco. The granules preferably should have a mesh size of 50 to 65 and, depending upon mesh size, the tobacco mixture may comprise up to 50% by weight of silicate, the silicate percentages being greater for larger particles and less for finer particles. Preferably, the tobacco-silicate mixture contains less than 25% silicates. The silicates can also be applied to the tobacco in solution form in drops. A considerably lower percentage of silicate solution by weight is added than when added in granular form silicates. When the cigarette is smoked, the sodium silicate foams up and forms a hard insulating mass interspersed with tobacco ashes accompanied with a release of the water of hydration. The fused silicate prevents dropping of tobacco ash and also acts as an insulator to prevent burning of any surface, such as furniture, on which the cigarette may be placed. Thus, it is clear that the burning cigarette is not actually extinguished but the burning zone is insulated from the substrate.

U.S. Pat. No. 4,230,131 relates to the use of flame-retardants as additives to the tobacco and/or the paper of cigarettes. Additives include boric acid and benzene-phosphoric acid in a range of 2.5 to 5.5 weight percent of the tobacco. The resulting cigarettes self-extinguished when left unattended within approximately two minutes.

U.S. Pat. No. 4,452,259 relates to a smoking article (cigarette) having at least one circumferential self-extinguishing band printed at about the center of the cigarette, the band containing a substance which is liquid in the temperature range of 100°–200° C. and which, as the burning cone comes into contact, forms a fluid film on the cigarette paper to restrict the flow of air to the burning cone to extinguish the cigarette within 2 to 5 minutes when it is not being actively puffed.

U.S. Pat. No. 4,146,040 relates to a fire resistant cigarette in which the wrapper is coated in separate steps with solution based coatings of an alkali metal silicate and a pH lowering material. The cigarettes are fire resistant in accordance with Federal test method DOC-FF-4-72 (Flammable Fabrics Act).

U.S. Pat. No. 4,187,862 approaches cigarette hazards by coating, in one or two operations, from 40 to 100% of the cigarette paper surface area with alkali metal silicate solutions, using $SiO_2$ as the principal fire retardant, resulting in a cigarette which will not self-extinguish when held in a horizontal position for one minute. The cigarettes are reported to pass a fire safety test derived from the Federal Flammability Standards For Mattresses, Fed. Register, Vol. 37, No. 110, June 7, 1972.

U.S. Pat. No. 4,453,553 relates to the selection of and treatment of low porosity cigarette wrapper with water or ethyl alcohol to reduce sidestream smoke and by depositing linear burn rate reducing cigarette wrapper substance on the paper selected from the group consisting of citric acid, magnesium citrate, magnesium acetate, tartaric acid, lactic acid, a sugar, non-fat milk and skim milk to impart fire resistance to the cigarette.

U.S. Pat. No. 3,220,418 relates to a cigarette having a non-combustible sheath wrapped around and in spaced relationship to the cigarette. The sheath retains the ashes and prevents the burn zone from contacting any combustible material. The sheath or the cigarette wrapper has applied thereto an intumescent water soluble alkali metal silicate which, upon intumescence, separates the wrapper and sheath to provide passageways for combustion air to the cigarette.

U.S. Pat. No. 3,528,432 discloses a cigarette with a flame-proofed insert which inhibits propagation of combustion. The insert is flame-proofed by a coating or impregnant of an ammonium salt of a metal-amido-polyphosphate complex.

U.S. Pat. No. 3,702,117 discloses cigarettes with flammability barriers or discs formed from specially prepared tobacco by compression into relatively thin flat discs disposed along the length of the cigarette which will extinguish an unattended cigarette. The discs are preferably treated with an impregnant selected from cottonseed oil, degras, lard and tallow to assure that the cigarette will continue to burn while being actively smoked.

U.S. Pat. No. 3,985,143 discloses self-extinguishing cigarettes having a small sack or container of water which is ruptured by the advancing burning tobacco thus extinguishing the cigarette.

Notwithstanding the essentially continuous and varied efforts over the decades to solve the fire-safety problem of cigarettes, the problem continues unabated. An effort to officially address the problem of cigarette safety is evidenced by the Cigarette Safety Act of 1984 (P.L. 98-567; 98 Stat. 2925, Oct. 30, 1984), which established the Technical Study Group on Cigarette and Little Cigar Fire Safety "to determine the technical and commercial feasibility, economic impact, and other consequences of developing cigarettes and little cigars that will have a minimum propensity to ignite upholstered furniture or mattresses."

SUMMARY OF THE INVENTION

The present invention relates to smoking articles such as cigarettes and little cigars having self-extinguishing properties when laid on a flat surface yet will not extinguish when held in the hand or placed in an ashtray. The self-extinguishing properties are achieved by modifying the tobacco by addition of moisture stable intumescent silicate fire retardant materials to thus modify the burning characteristics of the tobacco. Specifically, the invention relates to smoking articles made with tobacco compositions containing moisture stable alkali metal silicates containing borates, these compositions being resistant to degradation by moisture before they are intumesced.

DETAILED DESCRIPTION

Smoking articles, particularly cigarettes, are exceedingly complex products derived as a result of the careful but highly subjective balance of the myriad components of the smoking article. The ultimate fate of a smoking article is solely determined by the consumer. For this reason, there are over 1,400 additives available to manufacturers from which they can select the "right taste" for the consumer. Most of these additives are applied to the tobacco in the form of "casings" and "top dressings". The casings and top dressings are responsible for the distinctive taste and other characteristics of the different brands of commercial cigarettes and are, accordingly, highly proprietary formulations. Common flavorings include sugars, cocoa, licorice, fruit juices, molasses, sorbitol, spices, and other essential oils. To keep cigarettes fresh, humectant chemicals are added, the major ones being glycerol and propylene glycol. A major reason for the additives is to provide a "fresh" taste for the consumer. It is important to have the correct moisture content in the tobacco to provide proper burning rates as well as to obtain the full benefit of the taste additives. If moisture content is too high, spoilage can occur. If moisture content is too low, the leaf is too brittle, breakage occurs and the tobacco burns hot. The delicate balance of additives for consumer satisfaction is probably one of the reasons that cigarette fire safety efforts have been directed mainly to the wrapper and barrier devices, etc., rather than to the tobacco composition.

In this invention, the use of moisture stable alkali metal silicates as a constituent of the smoking tobacco overcomes the moisture sensitivity of tobacco treated with certain commercially available intumescent silicates. Cigarettes containing tobacco treated with certain of the commercially available silicates have resulted in a dark colored ash. In other cases, the treatment produced off-color (brownish) or spot-stained cigarettes. Further, the silicates absorbed atmospheric moisture resulting in a "wet" harsh tasting cigarette. The treated cigarettes of the present invention have good appearance, are resistant to moisture, have a long shelf life and achieve these results without altering taste.

The useful moisture stable alkali metal silicates are sodium silicate, lithium silicate, and potassium silicate; sodium silicate being preferred. The moisture stable alkali metal silicates are intumescent compositions comprising a mixture of alkali metal silicate, represented by the formula $M_2O{:}xSiO_2$, in which M is the alkali metal; at least one oxy boron compound, and water; in which X (weight ratio of silica to alkali metal oxide) ranges from about 1.5 to about 4, the molar ratio of boron to M is between about 0.2 and about 0.9, and the water comprises about 5 to 15 weight percent of the total composition. In this definition, the term oxy boron or borate means any compound having a radical which contains boron and oxygen, such as the metaborate, tetraborate, perborate, or polyborate radicals. The preparation of the material is described in detail in U.S. Pat. No. 4,521,333.

The present invention uses 50 to 250 μm borate stabilized alkali metal silicates in a range of from 15 to 25% by weight of the total tobacco composition, the tobacco composition having a moisture content of 12.5±1.0% moisture.

As earlier noted, consumer acceptable self-extinguishing cigarettes must continue to burn between active puff cycles, i.e., a hand-held or ashtray-held cigarette should not self-extinguish. Such cigarettes can be dropped by a dozing smoker onto furniture or bedding or from an ashtray onto a surface ranging from a table, paper or paper-like material or a carpeted floor. To test the efficacy of the self-extinguishing cigarettes of the present invention, two test surfaces were used. For a uniform and reproducible surface, Whatman No. 4 Qualitative filter paper placed on a full pad of notebook writing paper was found to be an excellent reproducible non-heat conducting test surface (hereafter referred to as "Paper Test"). A furniture or bedding test (hereafter referred to as "Furniture Test") was derived from the proposed standard for the "Flammability (Cigarette Ignition Resistance) of Upholstered Furniture (PFF-6-76)" and was used to test cigarettes with or without borate stabilized alkali metal silicate additive. For this test, cotton batting approximately 2 inches (5.1 cm) thick was covered with a cotton upholstery fabric. Cigarettes were lit, placed on the upholstery fabric, and covered with individual cotton sheeting material. The test was run until the cigarettes either self-extinguished or all the tobacco was consumed. After all smoldering had stopped, the test surface was taken apart and inspected. Cigarettes that produced scorches greater than 1.5 inches (3.8 cm) in length were considered failures.

Tobacco for making self-extinguishing cigarettes of the present invention was obtained from commercial cigarettes. The tobacco was carefully removed from the wrapper, moistened with gentle stirring just sufficiently to allow the borate stabilized alkali metal silicate granules to adhere to the tobacco shreds. The moisture addition was no more than about 5% by weight of the total moistened tobacco weight. Borate stabilized sodium silicate granules of 50 to 250 μm size, at varying weight percentages were added and distributed throughout the tobacco with tumble mixing. The commercial cigarette tobacco contains casing and a top dressing; thus, the only liquid addition was the water used to adhere the borate stabilized sodium silicate particles.

The particle size of the borate stabilized sodium silicate may affect the performance of the treated cigarette tobacco. The preferred particle size is in the 50–100 μm size range. Particles smaller than about 50 μm lose much of their intumescent qualities. Small amounts of the 50 μm size particles are tolerable, but large amounts admixed with the tobacco will not always provide the desired extinguishing properties.

Particles of 100–300 μm perform well in the Paper Test but tend to have a noisy burn (crackles) which may not be acceptable to the consumer.

The invention will be further illustrated by the following Examples.

EXAMPLE I

Borate stabilized sodium silicate compounds were prepared by adding 7.7 parts of boric acid to 100 parts of sodium silicate solution of 3.22 $SiO_2/Na_2O$ ratio and dried at 350° F. in a forced draft oven to a water content of about 10%. This material was crushed to a particle size of less than 105 μm and used as an additive to test in cigarettes.

Tobacco was stripped from commercial cigarettes, moistened with about 4–5% by weight addition of water, gently stirred to distribute the water, and 15% by weight based on weight of tobacco of borate stabilized sodium silicate granules were added and gently mixed to uniformly coat the tobacco. 0.75 grams of this mixture was loaded into paper cylinders containing a filter tip using the Golden Tip Star machine (available from Gizch-Werk Manufacturing Company, West Germany). The cigarettes were then air-dried until the added water evaporated.

Cigarettes made with 15%, 20% and 25% borate stabilized sodium silicate additive were tested for extinguishing properties in the Paper Test and in the Furniture Test (in this case, using a simulated chair seat made with two inches thick cotton batting covered by a cotton upholstery fabric). The results of these cigarette burn tests as well as results from burning cigarettes of the same composition on an ashtray are reported in Table I. Three to five cigarettes of each composition were tested.

TABLE I

| Cigarette No. | % Additive Loading | Burn Test Results | | |
|---|---|---|---|---|
| | | Paper Test | Furniture Test | Ashtray |
| 1 | 0 | Failed (1) | Failed (1) | Passed |
| 2 | 15 | Passed | Failed (1) | Passed |
| 3 | 20 | Passed | Passed | Passed |
| 4 | 25 | Passed | Passed | Failed (2) |

(1) - did not self-extinguish
(2) - self-extinguished

EXAMPLE II

The cone or flame temperature comparison was made to determine the endothermic effect of the borate stabilized sodium silicate. The tobacco source was a commercial brand "light" cigarette. Four grams of tobacco were blended with one gram of 105 μm borate stabilized sodium silicate additive. The tobacco was moistened with 0.35 grams water as an aid to adhere the particles to the tobacco. Cigarettes were made as in Example I with modified and unmodified tobacco using the Golden Tip machine. Chromel-alumel thermocouples were inserted to the center of each cigarette, and the peak cone temperature was determined as the flame front passed.

The control cigarette measured a peak flame temperature of 640° C.±50° C.; the modified cigarette flame temperature was 605° C.±28° C. When the cigarette tobacco was tightly packed by lightly tamping the cigarette, the peak cone temperature increased to 700° C.±15° C. control and 660° C.±14° C. for the treated tobacco.

EXAMPLE III

Combustion by-products of cigarettes were analyzed to determine the effect, if any, of the borate stabilized sodium silicate intumescent additive on the tobacco combustion process. These tests were carried out on cigarettes containing 15% additive. Surprisingly, gas chromatographic (GC) and mass spectrographic (MS) procedures showed a decrease in carbon monoxide and tars and an increase in nicotine as shown in Tables II and III.

TABLE II

| Description | % Loading | % Volume CO | % Volume $CO_2$ |
|---|---|---|---|
| Control - no additive | 0 | 1.8 | 5.8 |
| Commercial Brand X | 0 | 2.4 | 6.3 |
| Cigarette with additive | 15 | 1.2 | 4.5 |

The material trapped in the charcoal GC was extracted using methylene chloride and $CS_2$. The major components were identified as nicotine and glycerol di-acetate or tri-acetate. The MS determined values are given on a percent of the major quantity set at a 100% base as shown in Table III.

TABLE III

| Description | % Loading | % Nicotine | % glycerol di/tri-acetate |
|---|---|---|---|
| Control - no additive | 0 | 83 | 84 |
| Commercial Brand X | 0 | 86 | 100 |
| Cigarette with additive | 15 | 100 | 55 |

At these low loadings, the above results were obtained. At higher loadings, e.g., 20%, it would be reasonable to expect equal or better results.

What is claimed is:

1. A smoking article comprising a wrapper, a tobacco filler composition within said wrapper, said tobacco filler composition comprising tobacco shreds having mixed therewith a sufficient quantity of granular moisture stable alkali metal silicate, said alkali metal silicate represented by the formula $M_2O{:}xSiO_2$, in which M is the alkali metal; at least one oxyboron compound, and water; in which x (weight ratio of silica to alkali metal oxide) ranges from about 1.5 to about 4, the molar ratio of boron to M is between about 0.2 and about 0.9, and the water comprises about 5 to 15 weight percent of the total composition such that said smoking article lit and with the lit portion laid on a flat surface will self-extinguish yet will continue to burn between active puff cycles when held in the hand or placed in an ashtray with the lit portion out of contact with the ashtray.

2. A smoking article according to claim 1 wherein the moisture stable alkali metal silicate is borate stabilized sodium silicate.

3. A smoking article according to claim 1 wherein the granules of moisture stable alkali metal silicate have a particle size in the range of about 50 μm to about 250 μm.

4. A smoking article according to claim 3 wherein the granules of moisture stable alkali metal silicate comprise 15 to 25 weight percent of the total tobacco composition.

5. A smoking article according to claim 2 wherein the granules of borate stabilized sodium silicate have a particle size of about 100 μm and comprise about 20 weight percent of the total tobacco composition.

* * * * *